US006814649B2

(12) United States Patent
Schmall

(10) Patent No.: US 6,814,649 B2
(45) Date of Patent: Nov. 9, 2004

(54) FLUID JET CUTTING MACHINE WITH A SYSTEM FOR A CONTACT FREE GUIDANCE OF A SPACING SENSOR

(76) Inventor: Karl Heinz Schmall, Waldstrasse 20, Baden-Baden (DE), D-76532

( * ) Notice: Subject to any disclaimer, the term of this patent is extended or adjusted under 35 U.S.C. 154(b) by 101 days.

(21) Appl. No.: 10/310,582

(22) Filed: Dec. 5, 2002

(65) Prior Publication Data

US 2003/0109193 A1 Jun. 12, 2003

(30) Foreign Application Priority Data

Dec. 6, 2001 (EP) ..... 01128964

(51) Int. Cl.[7] ..... B24C 3/12
(52) U.S. Cl. ..... 451/2; 451/75
(58) Field of Search ..... 451/2, 5, 75, 8, 451/9, 10, 78, 102; 83/53, 177

(56) References Cited

U.S. PATENT DOCUMENTS

| | | | | |
|---|---|---|---|---|
| 3,978,748 A | * | 9/1976 | Leslie et al. | 83/53 |
| 4,848,042 A | * | 7/1989 | Smith et al. | 451/78 |
| 5,588,593 A | | 12/1996 | Boisture | |
| 6,049,580 A | | 4/2000 | Franck et al. | |
| 6,244,927 B1 | * | 6/2001 | Zeng | 451/2 |

FOREIGN PATENT DOCUMENTS

| | | |
|---|---|---|
| EP | 0 594 091 | 4/1994 |
| FR | 2 699 852 | 7/1994 |
| JP | 63 267198 | 11/1998 |

* cited by examiner

*Primary Examiner*—Robert A. Rose
(74) *Attorney, Agent, or Firm*—Collard & Roe, P.C.

(57) ABSTRACT

A fluid jet cutting machine comprising a selectively contactless or tactile sensor system for determining a spacing between the cutting device (outlet of the jet pipe) and the work piece. This device automatically trails the drive of the cutting head to maintain a defined constant spacing. An inductive sensor is used for metallic work pieces. The inductive proximity sensor is concentrically arranged around the jet pipe and determines, in a contactless manner, the spacing from the work piece, and transmits corresponding electrical signals to the drive of the cutting head for controlling the spacing. The inductive sensor is designed so that a ring chamber is concentrically arranged extending along the jet pipe leading to the outlet of the jet. It is possible to provide a pressurized flushing medium through this ring chamber via feed lines. This flushing medium flushes away the material removed by abrasion and the rebound particles in the course of the drilling and cutting process. A tactile attachment system is used with nonmetallic work pieces. The system is secured in a simple manner, on the main body of the sensor system.

14 Claims, 7 Drawing Sheets

FLUID JET CUTTING MACHINE WITH A SYSTEM FOR A CONTACT FREE GUIDANCE OF A SPACING SENSOR

BACKGROUND

This invention relates to a fluid jet cutting machine with a system for a contact free and selectively tactile guidance of a spacing sensor. Normally a fluid such as water or water and an abrasive can be used. In addition to the conventional thermal methods used in the cutting and separation operations of predominantly metallic plate-shaped work pieces via autogenous, oxyfuel plasma and laser cutting machines, the use of a non-thermal abrasive fluid jet cutting method is increasing worldwide.

In such a separation process, a continuous, thin jet of fluid such as water is applied and the fluid exits at a very high speed from a jet pipe at a distance of only a few millimeters from the work piece for the abrasive removal of material. Shortly before the fluid enters the jet pipe, very hard abrasives with very sharp edges and a fine grain size are added to the fluid. The fluid is under a pressure of a few thousand bar. These abrasives make it possible to treat both brittle and soft nonmetallic material, as well as almost all types of metal in an efficient manner.

One important distinction between thermal methods and fluid jet methods is that with thermal methods, the energy source, such as the gas/oxygen flame of the autogenous burner or the arc of a plasma burner, is brought adequately close to the work piece to liquefy the latter in the area where it is separated. With fluid jet cutting, there is no thermal treatment.

For fluid jet cutting, abrasive energy has its highest value in direct proximity of the outlet opening of the jet pipe. Therefore, the abrasive cutting process is most effective in this area.

It is necessary in both thermal separation methods and fluid jet cutting to maintain an optimal spacing or distance between the treating tool and the work piece.

Contact (tactile) and contactless guiding systems can be used for guiding the distance sensor to maintain the optimal distance. Guiding systems also ensure that if the position of the surface of the work piece does not remain horizontal when the tool is positioned in a vertical manner, such as when plates are supported in a position that is not completely horizontal, the clearance between the workpiece and this tool remains constant. These contactless guiding systems are used with thermal burning and laser cutting machines that automatically maintain the treatment distance during the cutting process via a trailing drive. Sliding shoes or sliding rings are used as tactile sensors. The position of these sensors in relation to the axis of treatment and direction of the work piece generates an electrical control signal that is used for trailing the treatment tool via a drive if deviations from the desired spacing should occur.

Non-contact sensors have generally been in use with thermal cutting machines for decades in the form of capacitive and inductive systems, and in the form of systems operating dependent on the arc voltage. Their electrical output signals are functions of the distance between the tool and the work piece as well.

It is not possible to use capacitive sensors in fluid jet cutting operations because these sensors will supply reliable signals only in a dry environment. Because of the treatment environment due to splash fluid, rebound, and accumulations of abrasive material, it is not possible to consider other non contact operating spacing sensor systems such as triangulation lasers and optoelectronic or ultrasound spacing or distance sensors.

Thus, in the past, fluid jet cutting machines with tactile distance (or spacing) sensors were used until now to determine the spacing or distance between the outlet opening of the jet pipe and the work piece before the drilling and cutting cycle starts. These sensors were then subsequently lifted off the work piece and not engaged further in the course of the cutting process.

Alternatively, the sensors are driven along in a sliding manner in the course of the drilling and subsequent cutting process while resting on the work piece.

With sliding tactile sensors, it is possible to carry out cutting operations with controlled regulation of the spacing both with metals and nonmetallic materials having an adequate strength. However, if the surfaces of the work pieces are sensitive, for example, such as the visible surfaces of metals or the surfaces of polished or glazed nonmetallic materials, problems arise due to scratching as a result of deposited abrasives and material removed from the surface of the work piece.

Inductive sensor systems have been used more recently in isolated fluid jet cutting operations for test purposes. These systems operate based on the principle of the retroactive effect of induced eddy current fields exerted on an inductance. These systems are not affected by fluid and steam. The rebound of the highly energetic fluid jet with the abrasive which occurs during the drilling process, but before the work piece is pierced or cut, puts extreme stress on the body of the sensor and destroys it after only a short operating time.

The inductive method cannot be used for nonmetallic materials because no eddy current fields are generated in such materials.

SUMMARY

The present invention relates to fluid jet cutting machines for metallic work pieces that have inductive spacing sensor systems operating without being in contact with the work piece. Sensor systems of this type are designed so that the drawbacks of former tactile sensor systems in the course of the cutting process are avoided. Furthermore, this design can be adapted in a tactile manner for nonmetallic materials with the help of an additional or attachment system. Moreover, this design contains means integrated in the construction for flushing away material accumulations collecting near the jet pipe and anti-wear barrier layers for protecting the bodies of the sensors.

According to the invention, such inductive sensor systems are preferably comprised of a cylindrical main body with a short structural length. This main body is concentrically pushed over the jet pipe and either clamped to this jet pipe, or to a clamping system used for clamping on to the jet pipe. Such a clamping system consists of a metallic component with a clamping device, and a nonmetallic component associated with the inductive sensor system. Such an inductive sensor system is partly enclosed by the metallic component so that it is largely protected from mechanical forces acting on it when it is in operation.

There is also a tubular flushing guide disposed concentrically in relation to the longitudinal axis of the ring-shaped sensor. A flushing medium, which is preferably water, is guided parallel with the jet pipe and, enclosed in this jet pipe, in the direction to the end of the jet pipe. This medium directly impacts the work piece in the treatment site and is capable of flushing away material accumulations to all sides.

The flushing medium is supplied to the main body via one or more guide tubes that are connected with one another in a fixed manner. These guide tubes are arranged so that the connections of the feed hoses remain outside of the area that could be reached by the rebound or abrasives acting on it.

The electrical connection of the inductive sensor system is designed so that two or more tubes preferably leading away from the treatment plane, are protruding from the main body. At least one of these tubes has a plug connector for connecting the sensor function.

The cylindrical main body is designed so that a tactile attachment system can be concentrically pushed over it, and can then be connected with the main body by clamping or screwing it to the body.

According to the invention, the tactile attachment system comprises a preferably metallic, tubular connection body, and a guiding device that contains high rigidity versus lateral forces, but only low stiffness versus deflective forces acting in the direction of the main axis. This guide device is movable and not supported in any sliding way and only encloses the inductive sensor device. It has a ring-shaped structure and, on the side facing the work piece, it is terminated by a ring-shaped metal plate that in turn supports a replaceable sliding ring that possesses high abrasive strength. According to the invention, this guiding device has an elastic constructional means with sliding components. In addition, according to the invention, the deflective force acting in the direction parallel with the main axis can be adjusted in a simple manner, so that it can be adapted to the requirements applicable in connection with tactile spacing guidance control.

BRIEF DESCRIPTION OF THE DRAWINGS

Other objects and features of the present invention will become apparent from the following detailed description considered in connection with the accompanying drawings which disclose at least one embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION

Figure 1A:
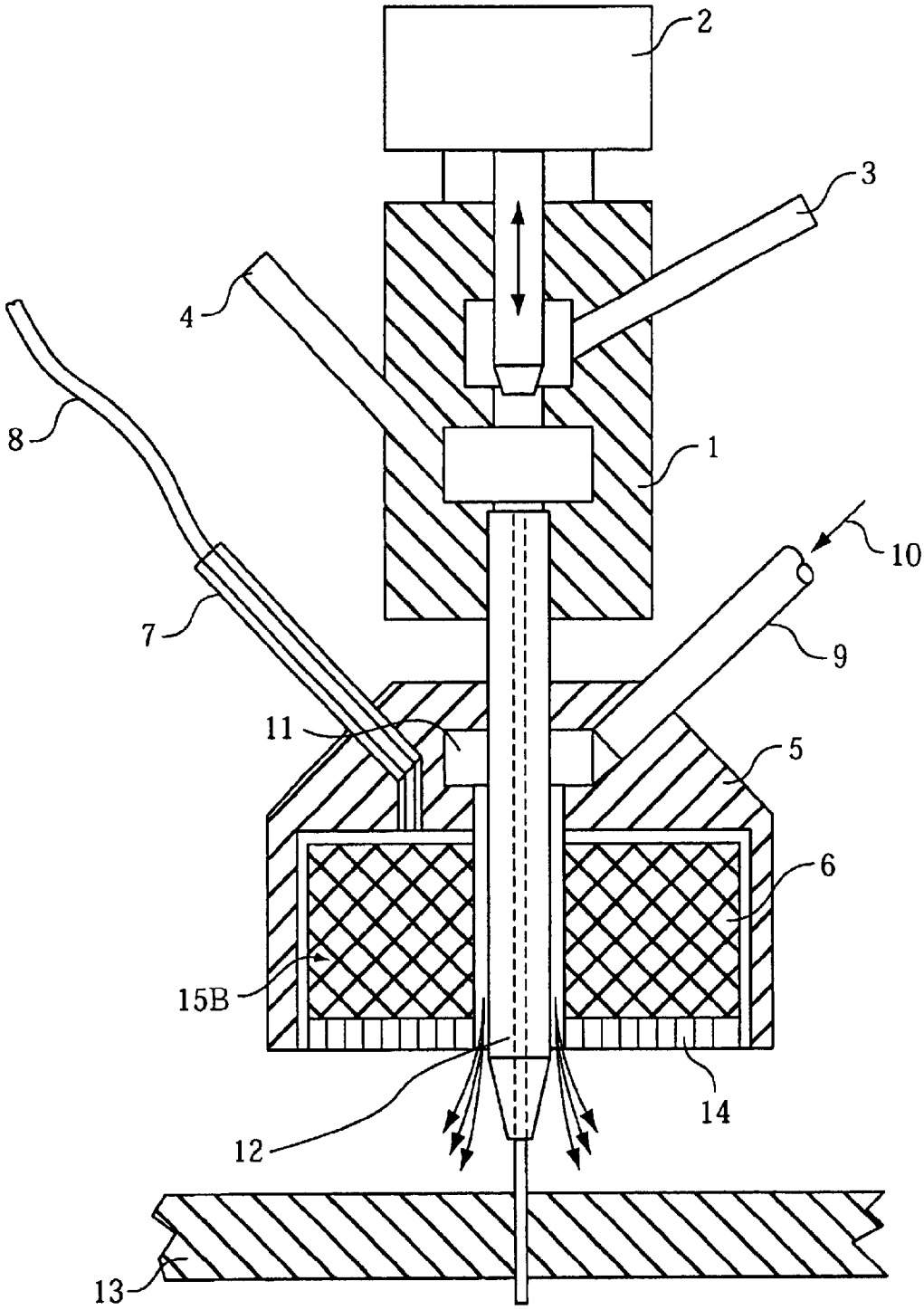
FIG. 1A is a cross-sectional view of a first embodiment of the device according to the invention.

Referring to the drawings, an embodiment of the present invention is shown in FIG. 1A it shows a fluid jet cutting head 1, and a valve 2 for the feed fluid, which is passed through pipe 3 and into cutting head 1. There is a feed tube 4 for feeding in an abrasive medium, which is added to the fluid in cutting head 1, and carried along by the fluid. After this mixture exits from a jet pipe 12, it is used to remove material from a work piece 13.

A main body 5 having a clamping device (not shown) is pushed concentrically over jet tube 12. Main body 5 supports sensor body 6 and partly encloses sensor body 6 on the sides for mechanically protecting sensor body 6.

A tube 7 is coupled to main body 5. Tube 7 receives a connection cable 8 for the electrical connection of sensor 6 which leads into main body 5.

Another tube 10 leads to a ring chamber 11. Ring chamber 11 extends parallel and concentrically with jet pipe 12 up to the point where jet pipe 12 exits from sensor body 6 with a smaller diameter.

A flushing medium, preferably water, is pressed with high pressure 10 through tube 9 and into ring chamber 11. As indicated by arrows in FIG. 1A, the fluid then flows at an increasing rate of flow parallel with jet tube 12, surrounding jet tube 12, and exits in the direction of the jet tube inlet.

The kinetic effect of the exiting flow of flushing medium removes material accumulations caused by the abrasive jet medium, wherein this material is flushed away to all sides. This flushing medium avoids material back-up and additional lateral stresses of the jet tube, as well as retroactive effects with metallic and non-metallic materials.

In the course of the "drilling" process, such as during the time in which the fluid jet is acting on the surface of work piece 13, until it pierces work piece 13, the entire amount of material removed by abrasion, together with the abrasive medium is thrown back in the direction opposing the direction of the jet. Thus, this material is thrown back in the direction of sensor body 6, and impacts the underside of the body of sensor 6 with high kinetic energy.

The material of sensor body 6 is at least partially resistant to such stresses. However, to reliably protect sensor body 6, this sensor body 6 has a protective plate 14 on its underside. The quality of plate 14 is such that it protects sensor 6 from the particles produced during the drilling process and, furthermore, it has a high abrasive strength. Depending on the requirements, this protective plate 14 can be replaced with just a few manipulations after it shows a certain amount of wear. To monitor the degree of wear of this protective plate, it has devices which, when a defined amount of wear is detected, trigger an electrical signal indicating that protective plate 14 needs to be replaced. This device is disposed in a number of different embodiments.

This device contains one or more electrical conductors subjected to a change of their electrical values or their conductivity after a defined degree of wear has been reached. This change is caused by the then-direct effect of the rebounding particles acting on them. This change is used to generate an electrical signal.

Figure 2A:
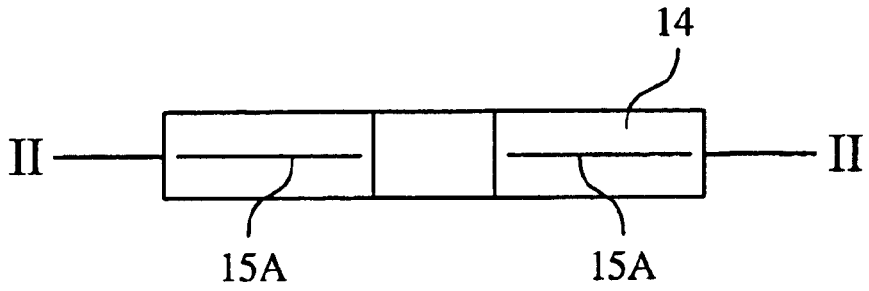
FIG. 2A is a cross-sectional view of the protective plate shown in FIG. 1A.
Figure 2B:
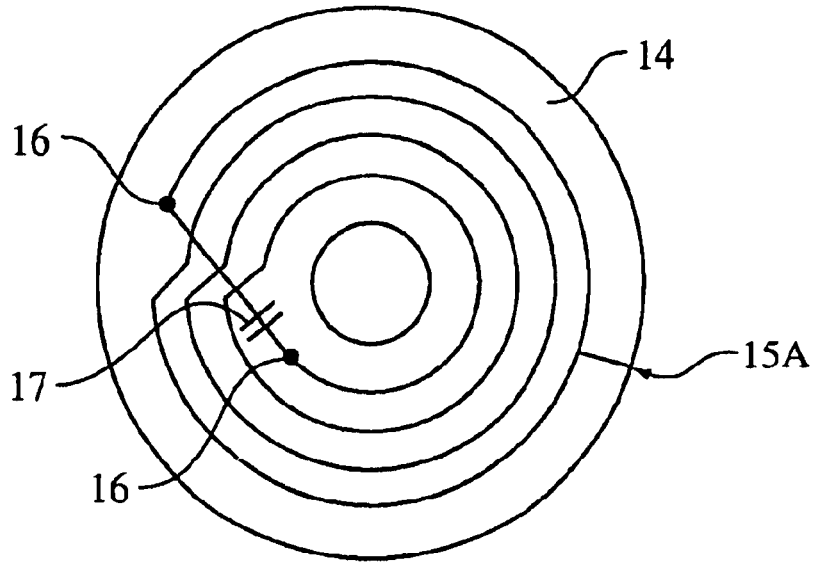
FIG. 2B is another cross-sectional view of the protective plate taken along the line II—II in FIG. 2A.

An embodiment of protective plate 14 is shown in FIGS. 2A and 2B. Plate 14 consists of a material similar to rubber. A conducting path arrangement 16 preferably in the form of a printed circuit on a thin substrate, or in the form of thin wires in a spiral arrangement, is directly embedded in the interior of plate 14 about in the center of plate 14. An electrical capacitor 17 connects the two ends of the spiral to each other, so that this arrangement forms a passive resonant circuit 15A with a defined resonant frequency.

Figure 1B:
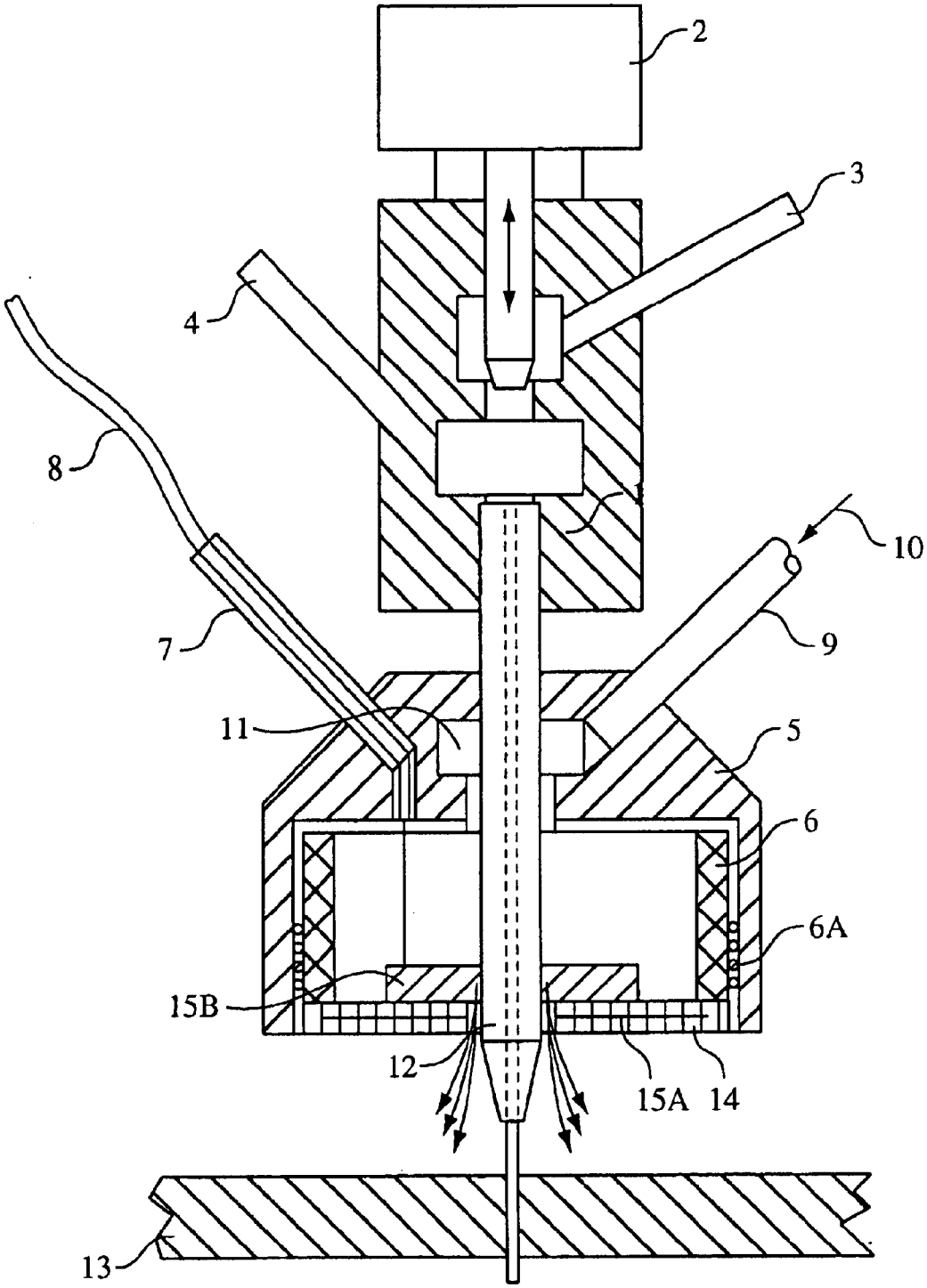
FIG. 1B is a cross sectional view of the first embodiment of the invention showing a positioning of the resonant circuit in a sensor body.

As shown in FIG. 1B there is an active resonant circuit 15B is contained in the body of sensor 6 in addition to the sensor arrangement as such. This active resonant circuit 15B is tuned to the same frequency as passive resonant circuit 15A disposed in protective plate 14, and is preferably in mutual reactance with passive resonant circuit 15A.

As shown in FIG. 1B there is a clearance sensor coil 6A that is part of an individual sensor system 6. This clearance sensor coil 6A measures the change in inductance caused by eddy currents generated inside the metallic workpiece by the electromagnetic AC field wherein this sensor circuit is a high frequency oscillating circuit.

The frequency changes when the inductance of sensor coil 6A is changed by approximation to the workpiece. Thus, the necessary or desired clearance corresponds to a particular frequency which is measured by a high rate of accuracy to control the tool drive to maintain a preselected clearance of the tool of the workpiece.

Oscillating or active resonant circuit 15B is an active oscillating circuit using a flat coil, which can be a printed circuit coil. Active resonant circuit 15B is positioned directly above passive resonant circuit 15A, so that the mutual inductance of passive resonant circuit 15A to active resonant circuit 15B is high enough to draw energy from coil or active resonant circuit 15B and thereby suppress self oscillation of active resonant circuit 15B as long as coil or passive resonant circuit 15A is not interrupted by wear of the protection plate. The oscillation frequency of sensor or active resonant circuit 15B is completely different from the frequency of clearance sensor 6 so that they do not interfere with each other. Thus, the signal associated with active sensor 15B is associated with the signal associated with passive resonant sensor 15A, but is not associated with the signal of sensor body 6.

The direct proximity of passive resonant circuit 15A in protective plate 14 and active resonant circuit 15B in the body of sensor 6 provides a close coupling of the two circuits. Passive resonant circuit 15A, in protective plate 14, withdraws a sufficient amount of energy from active resonant circuit 15B that is adequate so that active resonant circuit 15B will no longer be capable of satisfying the self-excitation condition. This causes active resonant circuit 15B of the oscillator to shut down and the oscillator no longer supplies any output voltage to generate a signal.

As soon as the wear of protective plate 14 has progressed to an extent so that the conductor paths are partly exposed and directly subjected to the action of the rebounding particles, interruptions occur on the conductor paths after a short operating time, so that the passive resonant circuit 15A in the protective plate is cut open. At this time, the oscillator will no longer be dampened, and it will be able to start oscillating immediately. Its output voltage generates the request signal suggesting that the operator "replace protective plate". This signal is also issued if the protective plate is missing. It can be used in the machine control for blocking the function of the cutting head.

Figure 3A:
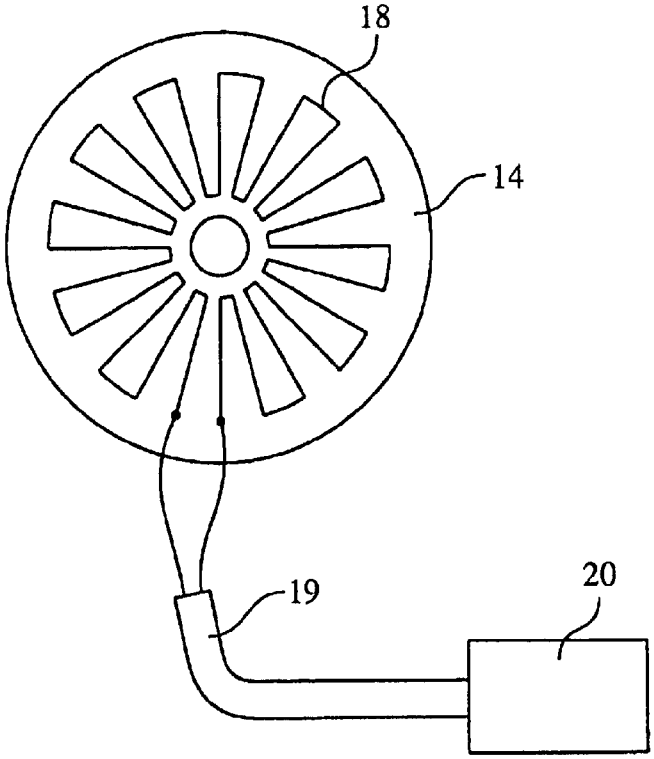
FIG. 3A is a second embodiment of the protective plate shown in FIG. 1A.
Figure 3B:
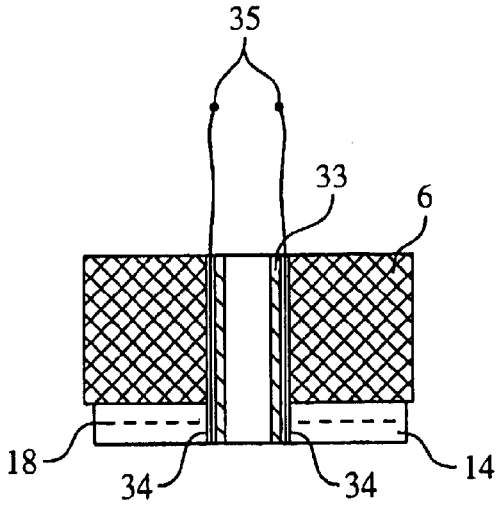
FIG. 3B is a partial side cross-sectional view of the device shown in FIG. 1A.

FIGS. 3A and 3B show another embodiment of the protective plate. To monitor the degree of wear, no resonant circuit is contained in the protective plate as shown in FIG. 2, but the two ends of the preferably meander-shaped or spiral conductor path 18 are connected to a cable connection 19 that leads to a monitoring circuit 20 monitoring the conductor path for interruption. As soon as the conductor path is interrupted in a site, monitoring circuit 20 responds and again generates the signal "replace protective plate".

FIG. 3A shows protective plate 14 with the arrangement of conductor path 18 in the form of a meander shaped intermediate layer. Conductor path 18 extends via cable 19 and via a plug connection (not shown) to monitoring circuit 20. Monitoring circuit 20 detects any interruption of the conductor path in any known manner. Another example of an embodiment of the electrical connection is shown in FIG. 3B. Conductor path 18 can be contacted directly on the body of the sensor. In FIG. 3B, sensor body 6 has an inner tube 33 made of an insulating material that has contacts 34 and connections 35. Conductor path 18 leads into protective plate 14 to the respective contact surfaces via contacts 34. FIG. 3B only represents the part of the sensor system required to be shown for understanding the present embodiment.

The invention can also contain an additional attachment system for controlling the spacing with the help of a tactile attachment to the inductive sensor. This additional attachment is based on the following functional principle:

With nonmetallic work pieces, or with work pieces with poor electrical conductivity, no eddy current can develop in the work piece due to the alternating magnetic fields of the inductive sensor. This means that the inductance of the sensor, or its distribution of the alternating field is not altered by the work piece and the sensor is not capable of generating any signals depending on the spacing.

Now, the nature of the tactile attachment system is such that a metallic body, preferably in the form of a ring 24 or a piece of tubing 23, is movably supported in the direction of the main axis of the jet pipe, and connected with a tactile, preferably ring-shaped, low-wear body 25 that is consequently resting on the work piece. In case the metal body has the shape of a ring, such a ring is arranged between the work piece and the body of sensor 6 and in parallel with this sensor, and can be deflected in the direction of the body of sensor 6.

If a piece of tubing 23 is used, this tubing 23 is arranged concentrically with the body of sensor 6, enclosing the sensor laterally, between the sensor body and the jacket-like extension of metallic main body 5. This piece of tubing 23 forms a short-circuit ring acting on the inductive sensor system. This ring 25 changes the electrical values of the sensor 6, depending on its position in relation to the sensor system.

Figure 4:
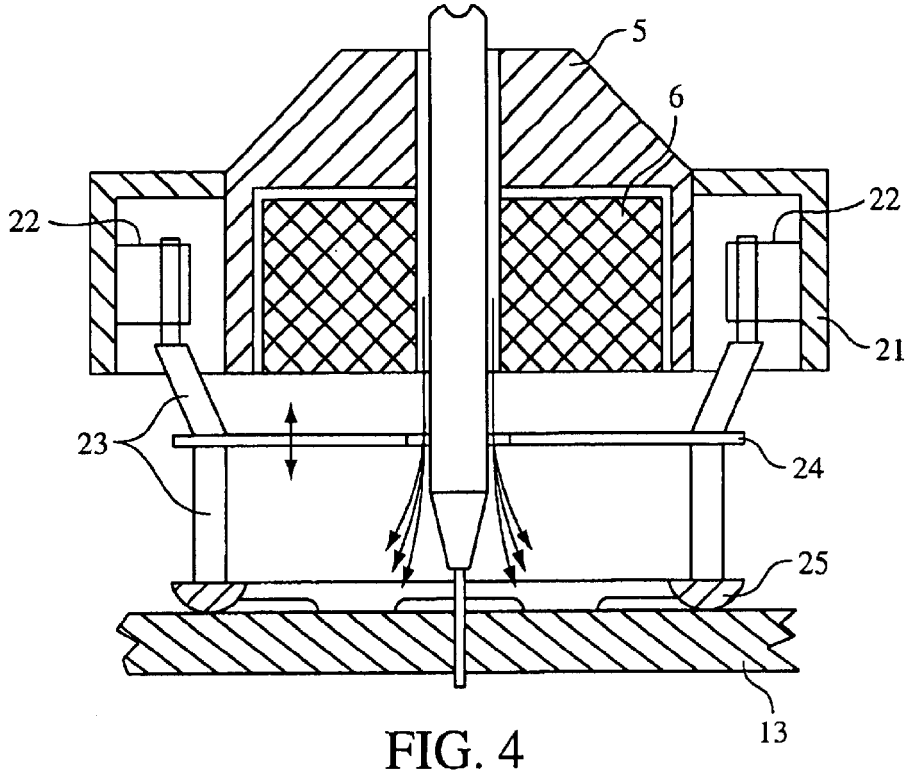
FIG. 4 is a side cross-sectional view of another embodiment of the invention.

FIG. 4 shows one of the possible embodiments of the additional tactile attachment system in the form of a ring-shaped metallic body 25 arranged between work piece 5 and the body of sensor 6, which is partly shown by a cross-sectional view for the sake of better understanding.

In FIG. 4, tactile attachment 21 is mounted on main body 5 and secured there to main body 5. Tactile attachment 21 contains a vertically deflectable guiding device 22 with stiff sides which is shown in greater detail in FIG. 6. This device comprises a plurality of support elements or tubes 23 that support metallic ring 24. These support elements 23 are capable of deflecting in parallel in the direction of the body of sensor 6. Support elements 23 lead on up to sliding ring 25, which is resting on work piece 13 when the cutting head is in its working position.

The position of the surface of the work piece can change in relation to the vertical position of the cutting head, or the sliding ring 25. The surface of the workpiece can move in the direction of sensor 6, or away from sensor 6 as well, driving metallic ring 24 along, so that metallic ring 24 will change its distance from the inductive sensor. In addition, in this embodiment, one or more rollers or wheel guides or hydraulic spacing guides will carry out the function of sliding ring 25.

If sensor body 6 is acted thereupon so that a metallic work piece was present below it, its output signal would represent a function of the distance (or spacing) from the work piece.

Metallic ring or ring-shaped body 24 may contain on its underside a protection against wear as well.

When cutting head 1 is displaced sideways and parallel with work piece 13 while the fluid jet is cutting, ring 25 will slide along on the work piece, whereby the flushing medium ensures—as indicated by arrows—that the abrasive particles will not be able to accumulate on sliding ring 25. Sliding ring 25 has breakthroughs through which the particles are flushed away to the outside.

Figure 5:
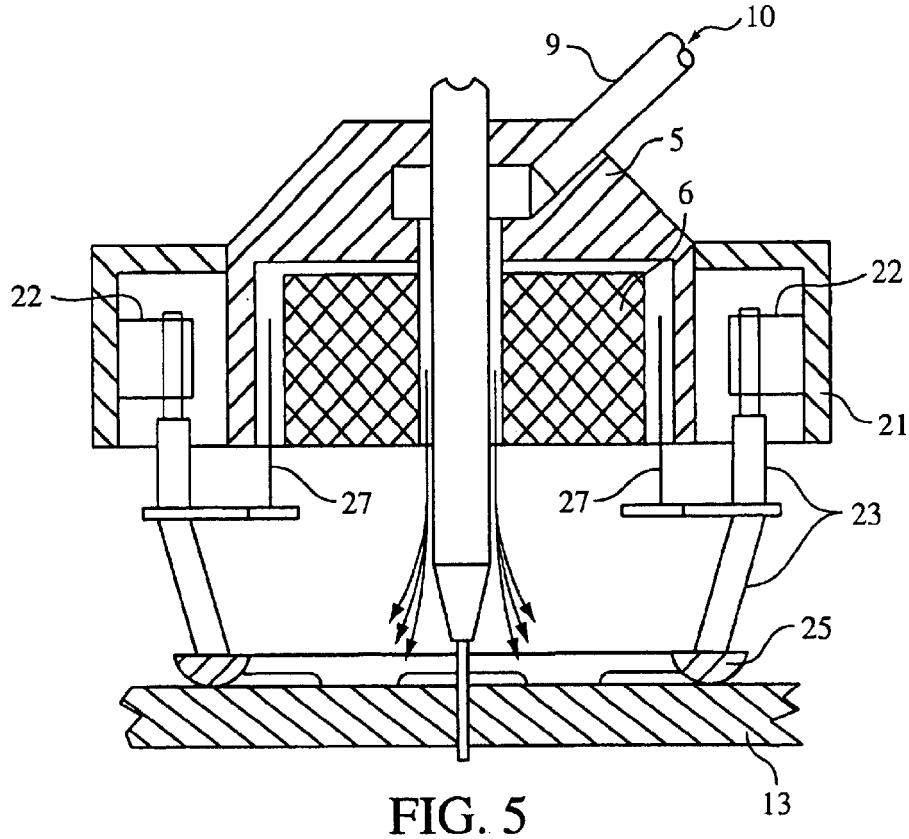
FIG. 5 shows another embodiment of a tactile measurement system that contains a tubular metal body.

FIG. 5 shows a similar arrangement of a tactile attachment system that contains a tubular metallic body. Instead of metallic ring 24 shown in FIG. 4, FIG. 5 shows the arrangement of a metallic tubular body 27 that is positioned concentrically around sensor body 6 and extends down to hollow ring 24A. By usefully arranging the coils in the interior of sensor body 6, the vertical displacement of metallic tubular body 27 allows the same output signals of sensor body 6 as the vertical displacement of metallic ring 24 arranged below sensor 6, or as a metallic work piece would ensue in the presence of the same vertical deflection or change in the spacing.

Figure 6A:
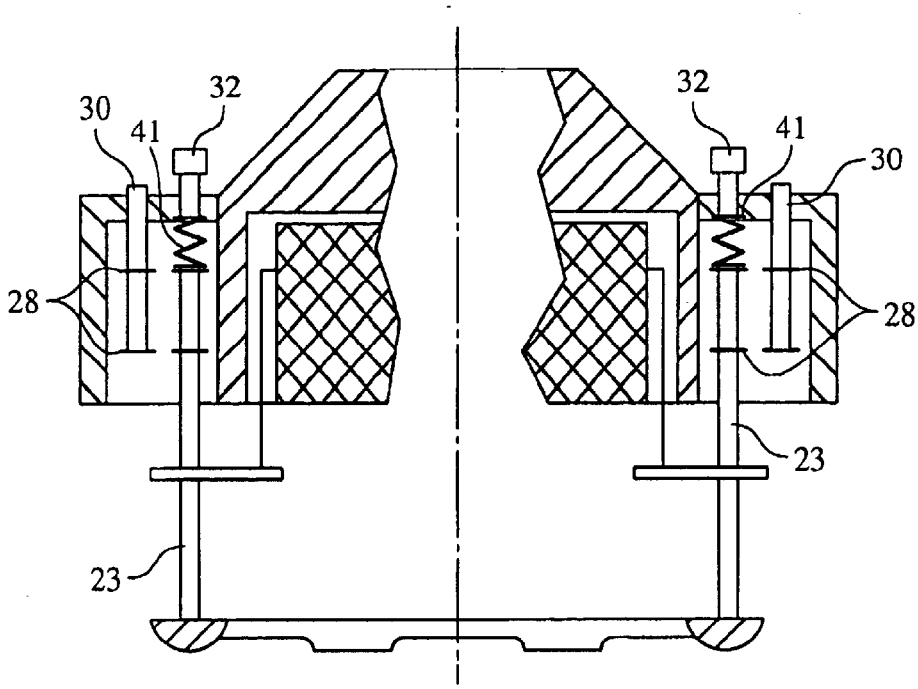
FIG. 6A shows a cross-sectional view of a guide device for guiding a mobile component of an auxiliary tactile attachment device.

An annular gap is shown in FIG. 5 between sensor body 6 and the extension of main sensor body 5. Tubular body 27 is moved in this gap. FIG. 6A shows another embodiment of a guide device for guiding the mobile component of an auxiliary tactile attachment device. The particularly severe environmental operating conditions to which the fluid jet sensor systems are exposed, require special constructional solutions for the support of the moving components of the additional tactile system.

According to the invention, a guiding system is used wherein this system comprises no sliding guide elements, but rather, has elastic elements that possess high rigidity within the guide system. This rigidity is opposed to the lateral forces due to the capability of sliding ring 25 or the roller/wheel guidance system which slides on the work piece, in the presence of low vertical deflection forces at the same time.

One of the special features of this guiding system are leaf spring segments 28 that are concentrically arranged in multiple numbers around sensor body 6 in two or more planes.

Each leaf spring segment 28 has a symmetrical slot that divides the element in 2 elastic strips of the same type, so that the elastic length is increased.

Figure 6B:
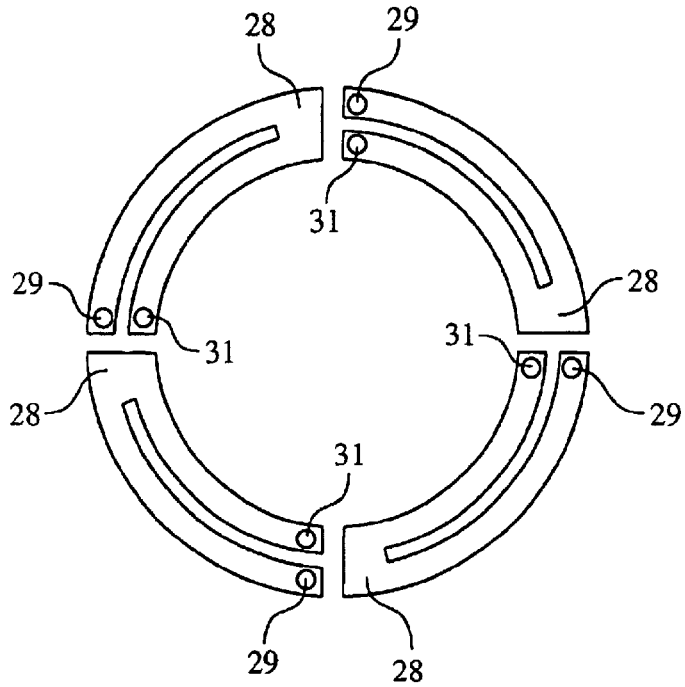
FIG. 6B shows a top view of a leaf spring segment shown in FIG. 6A.

As shown in FIG. 6B, at the end of leaf spring segment strips 28, there are a plurality of drilled holes 29 and 31. Punches 30, which can be secured with screws or rivets, are inserted through drilled holes 29. Punches 30 end in the body of the tactile attachment at the top, and fix the part of spring segment 28 that is disposed outwards in that position.

Drilled holes 31 receive the same type of punches as well. Punches 30 extend into holding elements 23 to hold sliding ring 25. Furthermore, additional springs 41 with adjusting screws 32 are arranged on the top side; wherein a downwardly directed spring force can be adjusted with these set screws.

A stop means not particularly shown in FIG. 6A for the inner spring segment strips, limits the spring path in the downward direction.

The movement and functionality of this non-sliding guiding system is shown in FIG. 6A, which only shows the leaf spring segments for the sake of a superior overview. The two inner spring segment strips are capable of moving at the open end in the direction away from, or toward the viewer, whereas the outer spring segment strips remain in their original positions. The closed end of the spring segment follows the bending path of the inner spring segment strips to about half of the distance of such a bending movement.

Figure 7:
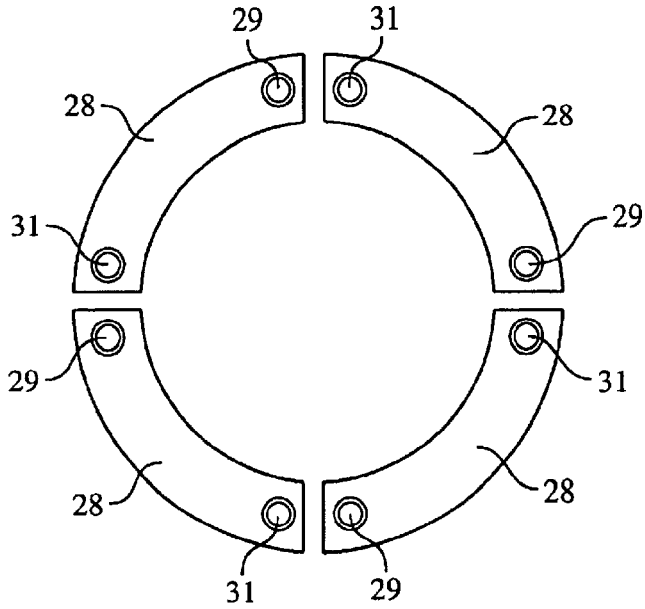
FIG. 7 shows a non slotted spring segment.

Because of the slotted spring segments, which are arranged in 2 or more planes, a particularly high lateral rigidity is achieved with a long path –f deflection. With a short distance of deflection, it is possible to also use non-slotted spring segments arranged in 2 or more planes, as is schematically shown in FIG. 7. Again, punches extend there through drilled holes 29 up to the body of the tactile attachment. In the present case, segments 33 are not slotted. Punches are arranged in drilled holes 31 there as well, leading to sliding ring 25 as shown in FIG. 6. This type of fastening represents only one variation of clamping on the additional body.

The function of this system with non-slotted spring segments corresponds in all other respects with the function shown in FIG. 6.

Hydraulic or pneumatic spacing guides are mentioned in the description of FIG. 4 on page 17 above.

Figure 8:
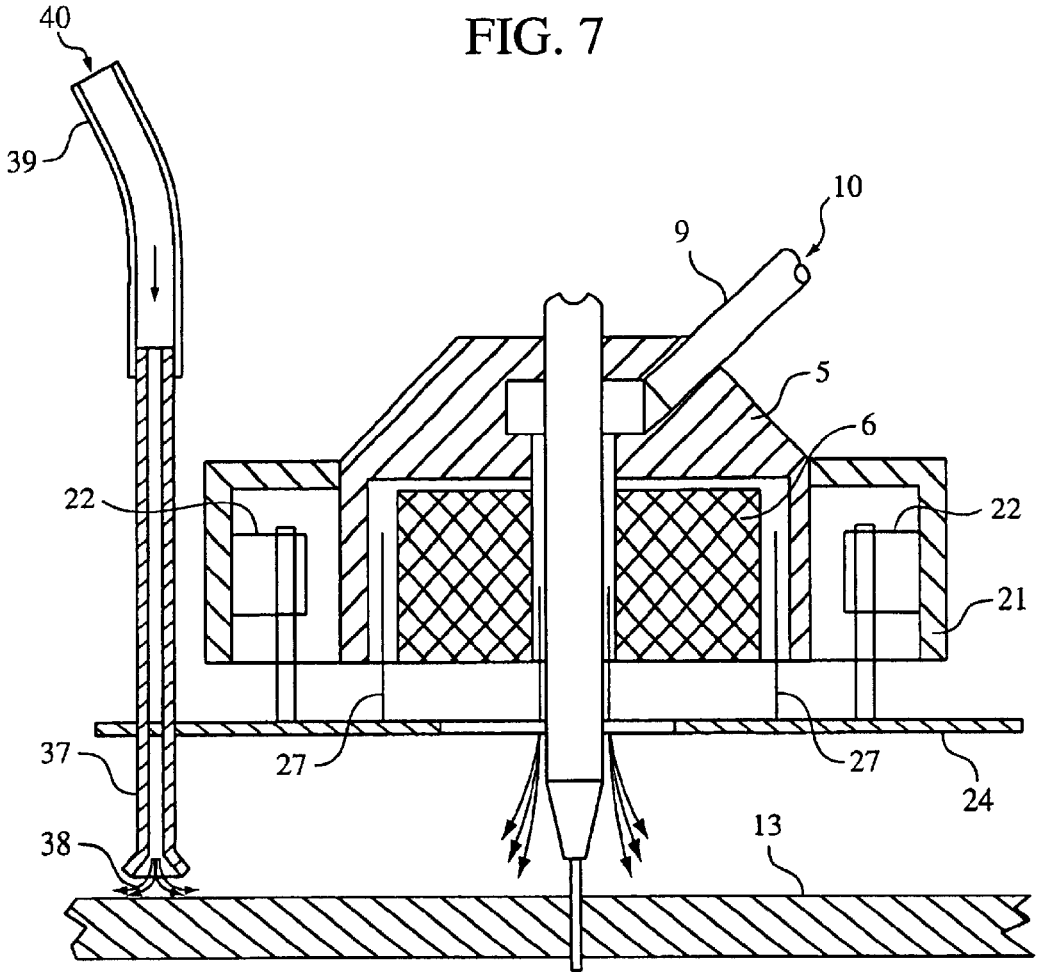
FIG. 8 shows another embodiment of the invention wherein hydraulic or pneumatic systems are used.

FIG. 8 shows a particularly advantageous embodiment of the tactile attachment system as defined by the invention, wherein hydraulic systems are used for the quasi-tactile spacing guidance system.

A plurality of vertically aligned tubes 37 is arranged on metallic ring 24. These tubes are advantageously positioned with an even distance from one another and in relation to the main axis of the sensor system. FIG. 8 shows only one such tube, which is sufficient to describe the function in a comprehensible way.

A preferably trumpet-shaped transition piece 38 or a corresponding widening of tube 37 is attached to the lower end of tubes 37. An easily flexible hose feed line 39, through which preferably water is supplied at a defined pressure 40, leads to the upper end of tube 37. The water or fluid exits at the lower end 38 and forms a back-up of fluid there. This back-up of fluid generates a force in an upward direction that depends on the fluid pressure and on the spacing between lower end 38 and work piece 13.

If the pressure is maintained at a constant level, the back-up pressure changes within a certain spacing range about proportionally to the distance or spacing. The back-up pressure is directed upwards and causes the elastically supported system of the attachment device to move until the equilibrium of the forces has been established. This corresponds with a defined spring displacement in the direction of the sensor, which causes ring 27 to generate a sensor signal corresponding with such a displacement in a manner as described above in FIG. 5.

Similar to the function of a sliding ring, the spacing between the outlet of the jet pipe and the work piece is converted in this manner into a sensor signal that can then be used for trailing the vertical drive for the cutting head at a constant distance (or spacing). The special advantage offered by this system is in its quasi-tactile mode of operation, the work piece is scanned without contacting it and the surface damage unavoidably caused on sensitive work pieces when tactile sliding or rolling bodies are used, are completely avoided. In addition, the fluid rushing out of tube 37 via the lower end 38 additionally flushes away the abrasion on the work piece. The same applies in the same sense to pneumatic back-up systems as well. When a plurality of tubes 37 are used, these tubes are arranged around the attachment device. This design results in another particularly important benefit that is obtained.

For example, if the cutting program of the machine control in the two horizontal axes X and Y is leading the cutting head near an edge or along an edge of the work piece, and if one single tube 37 is used, tube 37 might possibly be positioned outside of the work piece. Thus, it may not be possible in that case to control the spacing. However, if several tubes, for example if six of tubes 37 are arranged around the attachment device, at least one, and in most cases several of these tubes will always be positioned above the work piece. The back-up pressure of tubes 37 will then still act on the sensor system and assure control of the spacing.

Accordingly, while at least one embodiment of the present invention has been shown and described, it is to be understood that many changes and modifications may be made thereunto without departing from the spirit and scope of the invention as defined in the appended claims.

What is claimed is:

1. A fluid jet cutting machine for cutting a work piece and having a fluid jet cutting head, the cutting machine comprising:

a) a jet pipe coupled to the fluid jet cutting head for directing a jet of fluid onto the workpiece;

c) a main body having a first portion secured to said jet pipe concentrically surrounding said jet pipe, and a second portion providing gap between said main body and said jet pipe along a portion of the length of said jet pipe;

d) at least one external feed tube disposed at least partially in said main body and in communication with said gap, wherein said at least one external feed tube feeds a flushing media through said gap and along said jet pipe; and e) a cylindrically shaped sensor body disposed in said main body and surrounding said jet pipe, said sensor body having an inner hole having a diameter larger than said jet pipe and in communication with said gap for allowing the flushing media to flow therethrough.

2. The fluid jet cutting machine according to claim 1, wherein said main body comprises an extension partially enclosing said sensor body in a form of a ring, wherein said main body protects said sensor body against lateral mechanical stresses.

3. The fluid jet cutting machine as in claim 1, further comprising a protective plate disposed adjacent to said sensor body, wherein said protective plate comprises an abrasion resistant interchangeable nonmetallic material coupled to said main body to protect said sensor body from abrasion from a rebound of abrasive jet media, and said cutting machine further comprises a wear system for determining a maximum degree of wear in said plates, and wherein said wear system triggers an electrical monitoring signal when said maximum degree of wear has been reached.

4. The fluid jet cutting machine as in claim 3, wherein said wear system comprises a conductor path arrangement in an interior portion of said protective plate, and a monitoring circuit coupled to said conductor path arrangement, wherein when said conductor path arrangement is interrupted at a defined degree of wear, it triggers a switching signal via said monitoring circuit to indicate that said protective plate is worn.

5. The fluid jet cutting machine as in claim 1, wherein said wear system further comprising a passive resonant circuit comprising an electrical capacitor coupled to said conductor path, wherein said conductor path has a spiral shape and forms an inductance, wherein two ends of said conductor path are connected to each other by said electrical capacitor to form said passive resonant circuit, said wear system further comprising an active resonant circuit disposed in said sensor body, wherein said active resonant circuit is independent of said sensor body and tuned to a same or similar resonant frequency as said passive resonant circuit, wherein said passive resonant circuit which is disposed in said protective plate draws energy from said active resonant circuit as long as said passive resonant circuit is not interrupted, wherein said passive resonant circuit, after it has been interrupted, enables said active resonant circuit to generate a reporting signal requesting replacement of said protective plate.

6. The fluid jet cutting machine as in claim 4, further comprising a cable, which is coupled at one end to said monitoring circuit and at a second end to said conductor path system, wherein said conductor path system has a spiral or meander shape that has at least two ends that lead to said cable, wherein said monitoring circuit triggers a report signal if said conductor path is interrupted by wear of said protective plate.

7. The fluid jet cutting machine as in claim 4, wherein said conductor path system has an approximately spiral shape in a center region and an outer meander-shaped region and has two ends wherein both of said two ends are connected with each other to form a short circuit ring, wherein said ring is coupled to said active resonant circuit and disposed in said sensor body, wherein said conductor path system is interrupted by a retroaction acting on said meander shaped region, wherein the oscillating frequency of said active resonant circuit is substantially changed and said change reports a signal in said monitoring circuit connected downstream.

8. The fluid jet cutting guiding system as in claim 1, further comprising:

a tactile or quasi tactile attachment for determinating the spacing between said jet pipe and the work piece;

wherein said tactile attachment includes a carrier body which includes a vertically deflectable guard device clamped to said main body and a tubular support element;

at least one ring shaped body, and at least one pneumatic or hydraulic tactile attachment for coupling said tubular support element to said deflectable guard device, said pneumatic or hydraulic tactile attachment for influencing said sensor body wherein a movement of said main body in relating to said sensor body is provided by a tactile sliding or rolling device or by a back pressure system.

9. The fluid jet cutting machine as in claim 8, wherein said ring shaped body is movably arranged below said sensor body, so that when a change occurs in a position of said ring shaped body in relation to said sensor body, said sensor body generates an output signal in a same or similar manner as the metallic work piece.

10. The fluid jet cutting machine as in claim 8, further comprising a guiding system, wherein said tubular support element which is guided by said guiding system is disposed concentrically with said sensor body, so as to enclose said sensor body wherein when there is a position change in a direction of a main vertical axis, said sensor body generates a corresponding output signal in a same or similar manner as with the metallic work piece.

11. The fluid jet cutting machine as in claim 10, wherein said guiding system comprises:

a plurality of leaf springs coupled to said main body;

a ring shaped body surrounding said main body and coupling all of said plurality of leaf springs together; and a plurality of additional tensionable springs coupled at one end to said main body and at an opposite end to said ring shaped body, wherein said plurality of additional tensionable springs can variably adjust the tension on said plurality of leaf springs.

12. The fluid jet cutting machine as in claim 11, further comprising a replaceable tactile sliding ring that contains a plurality of slots on its side facing said work piece, said slots allowing for a flushing process of said sliding ring.

13. The fluid jet cutting machine as in claim 11, further comprising at least one tactile rolling body mounted on said ring shaped body, said at least one tactile rolling body rolling off on top of the work piece during the cutting process.

14. The fluid jet cutting machine as in claim 11, wherein said tactile attachment comprises a plurality of hydraulic back-pressure tubes, spaced apart from each other and coupled to said ring shaped body wherein when a back up pressure from said tubes displaces said guiding system, said sensor body generates a signal depending on said spacing of an end of said hydraulic back pressure tubes from the work piece.

* * * * *